US005207359A

United States Patent [19]

Steijns

[11] Patent Number: 5,207,359

[45] Date of Patent: May 4, 1993

[54] TAMPER EVIDENT COVER FOR SPRAYER NOZZLE

[75] Inventor: Emile B. Steijns, Lierop, Netherlands

[73] Assignee: AFA Products, Inc., Forest City, N.C.

[21] Appl. No.: 840,764

[22] Filed: Feb. 24, 1992

[51] Int. Cl.[5] ..... B67D 5/32

[52] U.S. Cl. ..... 222/383; 222/380; 222/384; 215/253; 215/258

[58] Field of Search ..... 222/153, 321, 380, 383, 222/384, 385, 378, 541; 239/333, 394; 215/209, 241, 253, 251, 258

[56] References Cited

U.S. PATENT DOCUMENTS

| | | | |
|---|---|---|---|
| 4,946,074 | 8/1990 | Grogan | 222/153 |
| 4,971,227 | 11/1990 | Knickerbocker et al. | 222/153 |
| 5,046,646 | 9/1991 | Stull | 222/541 |

FOREIGN PATENT DOCUMENTS

| | | | |
|---|---|---|---|
| 694678 | 9/1964 | Canada | 222/153 |
| 2108215 | 5/1983 | United Kingdom | 222/153 |

*Primary Examiner*—Andres Kashnikow
*Assistant Examiner*—Anthoula Pomrening
*Attorney, Agent, or Firm*—Thomas R. Vigil

[57] ABSTRACT

The tamper evident cover assembly is used with a sprayer nozzle of a trigger sprayer of the type including a body, a trigger movably mounted to the body for operating a pumping mechanism upon actuation thereof and a sprayer nozzle at the front end of the body. The tamper evident cover assembly comprises a cover for the nozzle, at least one flange extending rearwardly from the cover and having first coupling structure thereon for coupling to the trigger, a frangible connection between the flange and the cover, and, second coupling structure on the trigger for coupling with the first coupling structure upon the flange, whereby actuation of the trigger will cause the cover to be pulled against the nozzle to cause tensioning and breaking of the frangible connection between the flange and the cover and separation of the cover from the sprayer nozzle, such resulting separation being evidence of tampering with the trigger sprayer.

11 Claims, 4 Drawing Sheets

TAMPER EVIDENT COVER FOR SPRAYER NOZZLE

BACKGROUND OF THE INVENTION

1. Field of the Invention

The present invention relates a tamper evident cover for a sprayer nozzle of the type that is at the front end of a trigger sprayer. More specifically, the present invention relates to a cover which is received over a nozzle cap of a sprayer nozzle and has at least one rearwardly extending flange for coupling to a trigger. The flange has a frangible connection to the cover such that when the trigger is actuated the flange is broken away from the cover and the cover pops off of the nozzle cap.

2. Description of the Related Art Including Information Disclosed Under 37 CFR §1.97-1.99

Heretofore, various types of tamper evident trigger sprayers have been proposed. Two examples of previously proposed trigger sprayers having tamper proof or tamper evident structure thereon are disclosed in the following two patents:

| U.S. Pat. No. | Patentee |
|---|---|
| 4,946,074 | Grogan |
| 4,971,227 | Knickerbocker et al. |

In the Grogan U.S. Pat. No. 4,946,074 a tamper evident manually actuated pump sprayer is disclosed, which includes a locking device extending between the trigger and a confronting portion of the pump body and abuts against a trigger flange. When pushing the trigger, the locking device breaks and falls apart so that it is impossible to replace the locking device after having squeezed the trigger. In another embodiment, the device engages the underside of the trigger and snap fits into a sprayer nozzle cap located adjacent the trigger. After pulling off this locking device, some projections will remain within the nozzle without interfering with intended use.

In the Knickerbocker et al U.S. Pat. No. 4,971,227 a manually actuated sprayer is disclosed, having a nozzle rotatable from OFF to ON positions. A removable tear strip or a removable cap is provided for preventing rotation from the OFF position. Upon removal of the tear strip or cap, the nozzle is free to be rotated to its ON position. By removing the tear strip, it is destroyed and therefore, it cannot be replaced, which provides evidence to the user that the nozzle has been tampered with. The tear strip is almost an extension of the body of the dispensing device and molded thereto. The tear strip covers partially the nozzle cap and since the tear strip is fixed on the body of the dispensing device, the nozzle cap cannot be rotated without removing the tear strip beforehand.

The dispensing device of the present invention differs from these previously proposed structures by providing a tamper evident/tamper proof nozzle cover assembly that includes a different type of tamper evident/tamper proof structure and is thereby distinguished over the teachings of the Grogan and Knickerbocker et al. patents.

SUMMARY OF THE INVENTION

According to the present invention there is provided a tamper evident cover assembly for a sprayer nozzle of a trigger sprayer of the type including a body, a trigger movably mounted to the body for operating a pumping mechanism upon actuation thereof and a sprayer nozzle at the front end of the body, the tamper evident cover assembly comprising:

a cover for the nozzle;

at least one flange extending rearwardly from the cover and having first coupling means thereon for coupling to the trigger, a frangible connection between the flange and the cover, and, second coupling means on the trigger for coupling with the first coupling means on the flange, whereby actuation of the trigger will cause tensioning and breaking of the frangible connection between the flange and the cover, such breaking of said frangible connection being evidence of tampering with the trigger sprayer.

DESCRIPTION OF THE PREFERRED EMBODIMENT(S)

Figure 1:
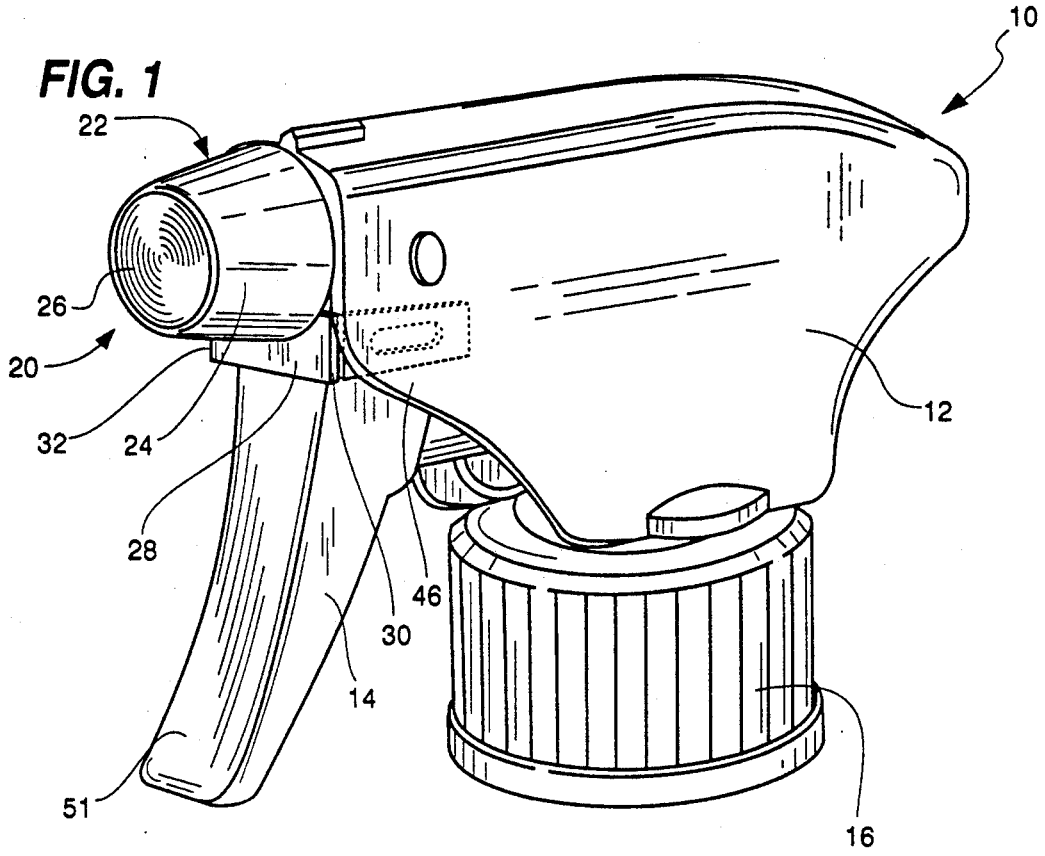
FIG. 1 is a perspective view of a trigger sprayer having a tamper evident cover assembly constructed according to the teachings of the present invention mounted thereon.
Figure 2:
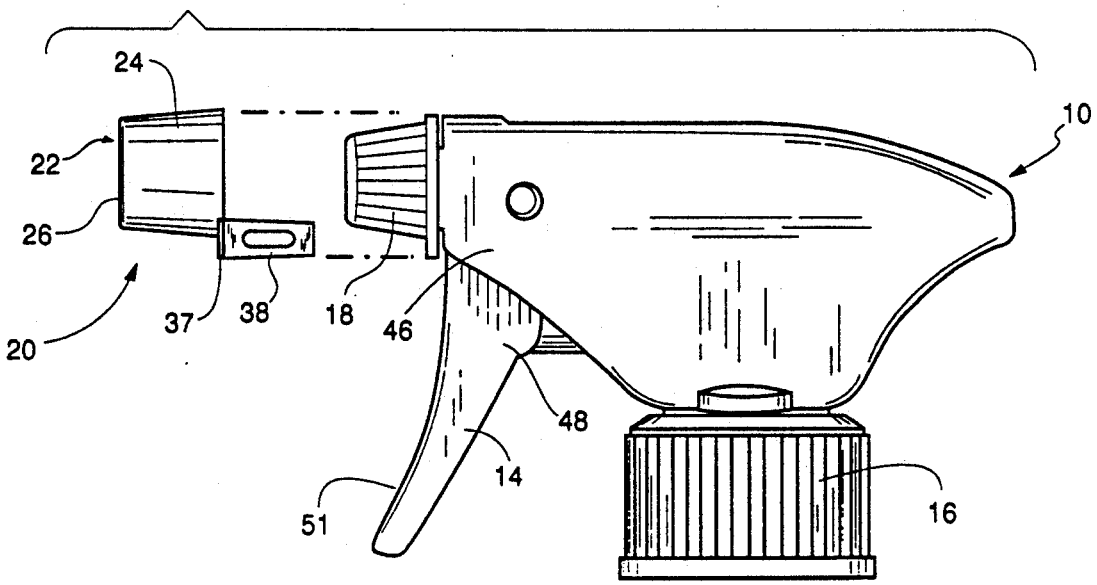
FIG. 2 is a side elevational view of the trigger sprayer shown in FIG. 1 with the tamper evident cover assembly spaced outwardly from a nozzle cap of the trigger sprayer.

Referring now to the drawings in greater detail, there is illustrated in FIG. 1 a trigger sprayer 10 comprising a body 12 and a trigger 14 movably mounted to the body 12 for engaging a pumping mechanism hidden from view and of conventional construction within the body 12 for pumping liquid from a bottle connected to the body 12 by a bottle cap 16 and out of an outlet orifice of a nozzle cap 18 (FIG. 2).

According to the teachings of the present invention, a tamper evident cover assembly 20 is releasably mounted over the nozzle cap 18 and coupled to the trigger 14. The tamper evident cover assembly 20 includes a cup shaped cover 22 which has side walls configured to mate with and be received over the side walls of the nozzle cap 18. Here, the nozzle cap 18 is generally conical in shape and the cover 22 has a similar conically shaped side wall 24 and a front wall 26 (the bottom of the cup shape). It will be understood that the cover 22 can have other shaped side walls, such as generally square frustoconical shaped side walls for being received over a generally square shaped nozzle cap.

The generally conically shaped side wall 24 of the cover 22 has, at its lower rear edge, a generally rectangular bottom panel 28 integral therewith and depending from the bottom side thereof. The bottom panel 28 has left and right side edges 30 and 32.

A reduced thickness line of material 34 or 36 along the rear edge of each of the side edges 30 and 32 frangibly connects the panel 28 to left and right generally rectangular rearwardly extending flanges 38 and 40.

Each of the flanges 38 and 40 has an elongate oval shaped opening 42 therein which is rounded at the front and rear ends 43, 44 thereof.

The flanges 38 and 40 are adapted to be received between a left or right side wall portion 46 at the front end of the body 12 and a side wall 48 or 50 of the trigger 14 which extend rearwardly from a front wall 51 of the trigger 14.

Figure 3:
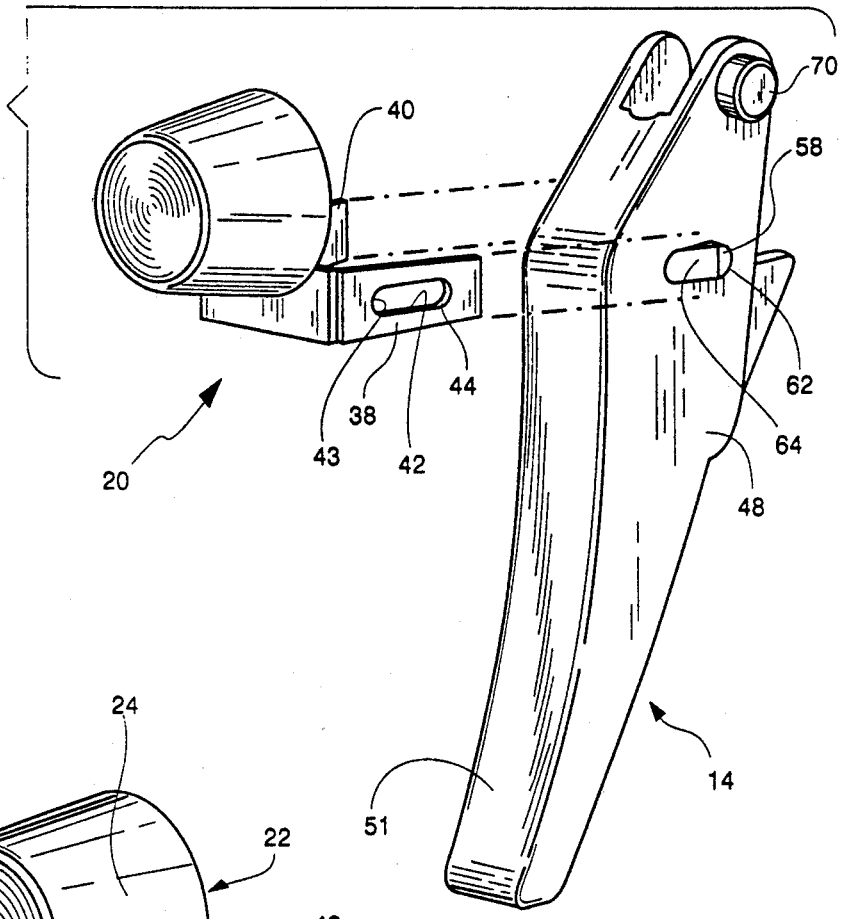
FIG. 3 is a perspective, exploded view of the trigger of the sprayer and the tamper evident cover assembly.
Figure 4:
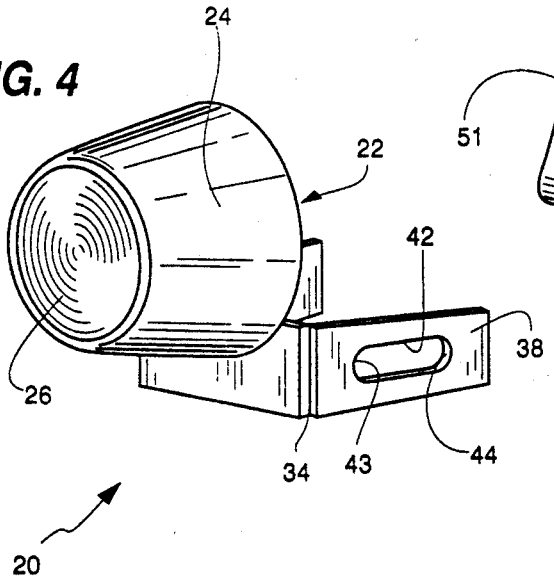
FIG. 4 is a perspective view of the tamper evident cover assembly.
Figure 5:
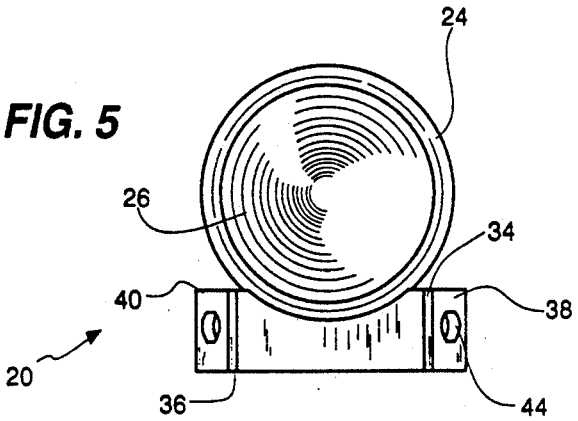
FIG. 5 is a front elevation view of the tamper evident cover assembly.
Figure 6:
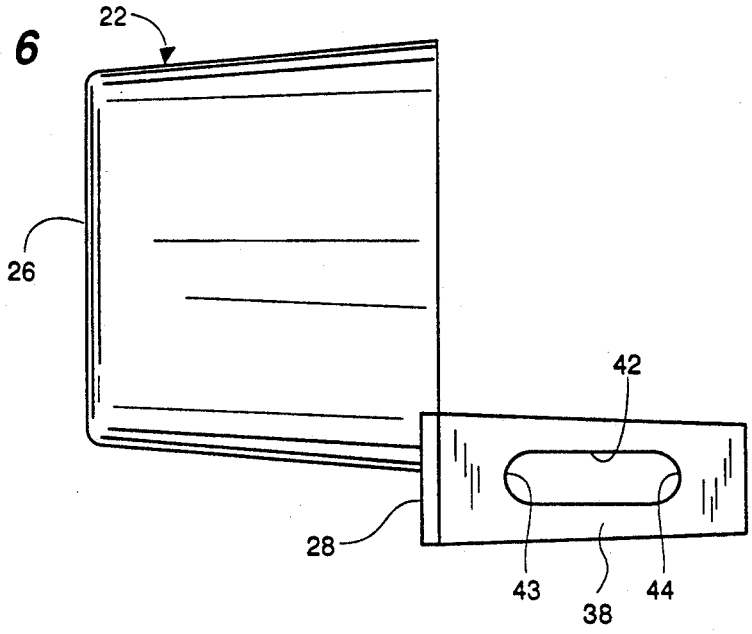
FIG. 6 is a side elevational view of the tamper evident cover assembly.
Figure 8:
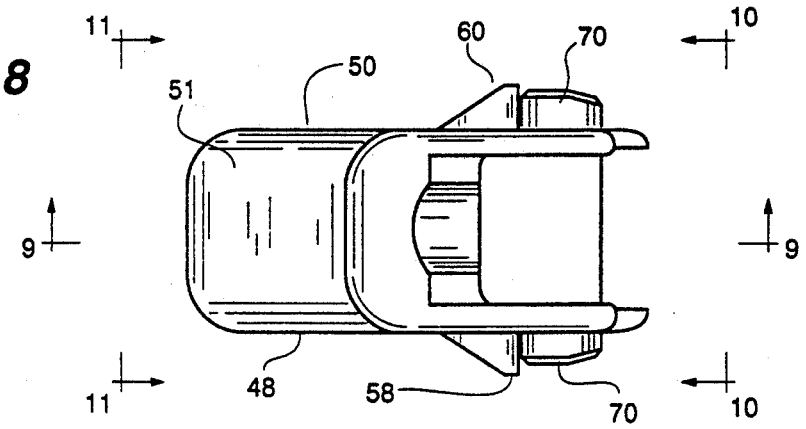
FIG. 8 is a top plan view of the trigger shown in FIG. 3.
Figure 9:
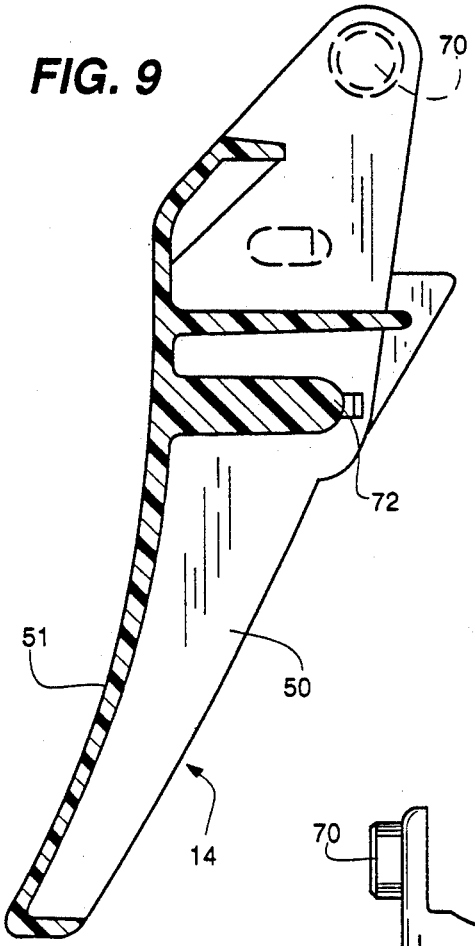
FIG. 9 is a vertical sectional view of the trigger shown in FIG. 8 and is taken along line 9—9 of FIG. 8.
Figure 10:
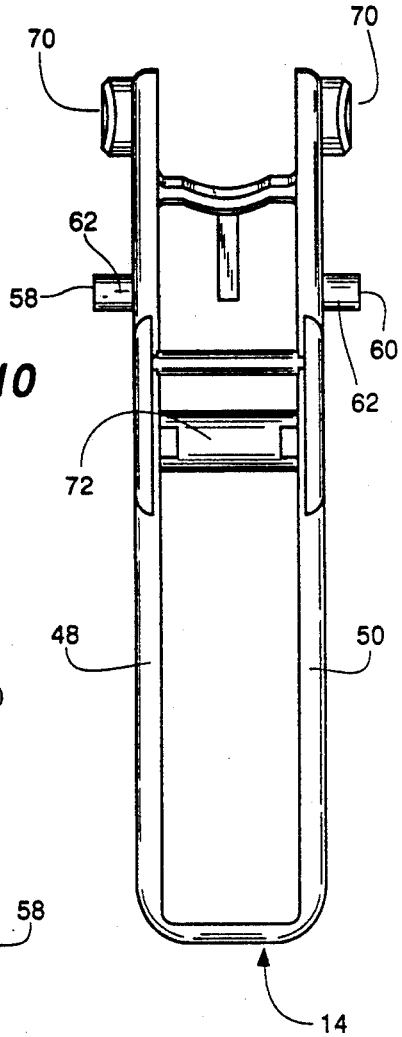
FIG. 10 is a back elevational view of the trigger shown in FIG. 8 and is taken along line 10—10 of FIG. 8.
Figure 11:
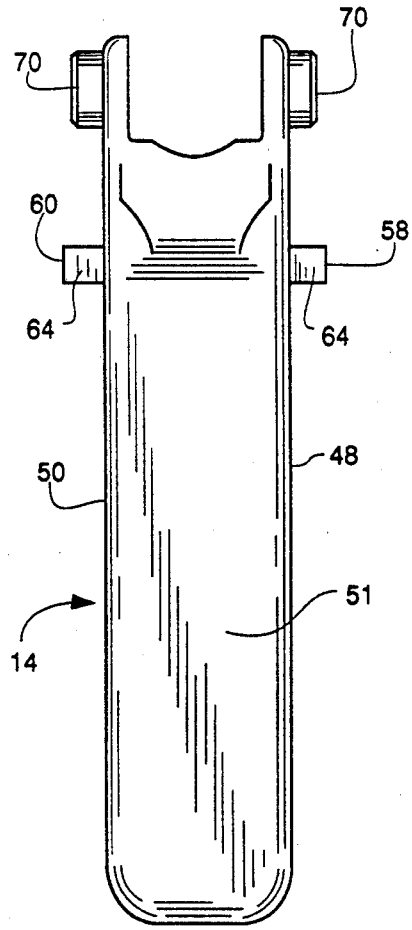
FIG. 11 is a front elevational view of the trigger shown in FIG. 8 and is taken along line 11—11 of FIG. 8.

The oval shaped opening 42 defines a first coupling means on each of the flanges 38 and 40 and the trigger 14 has mating second coupling means in the form of a detent 58 or 60 (FIGS. 9, 10 and 11) extending laterally outwardly from each side 48 and wall 50, respectively of the trigger 14. As shown in FIGS. 3 and 8, each detent 58 or 60 has a rounded back side surface 62 and an inclined front ramp-shaped surface 64 which extends rearwardly and outwardly on the detent 58 or 60 from the trigger side wall 48 or 50.

Other parts of the trigger, such as side mounting pins 70 and a piston rod engaging bar 72, are conventional.

It will be easily understood that in assembling the tamper evident cover assembly 20 over the nozzle cap 18 and in coupling engagement with the trigger 14 , the flanges 38 and 40 are slid along the side walls 48 and 50 of the trigger 14 inside the wall portions 46 at the front end of the body 12 along the ramp surface 64 of each of the detents 58 and 60 until the opening 42 snaps over the detent 58 or 60 and the rounded end 44 of the opening 42 engages the rounded back surface 62 of the detent 58 or 60 to lock the tamper evident cover assembly 20 onto the trigger 14.

Then, when anyone tampers with, i.e., pulls, the trigger 14, the detents 58 and 60 pull the flanges 38 and 40 backwardly and break the frangible, reduced thickness connections 34 and 36 thereby detaching the cover 22 from the flanges 38 and 40.

Figure 7:
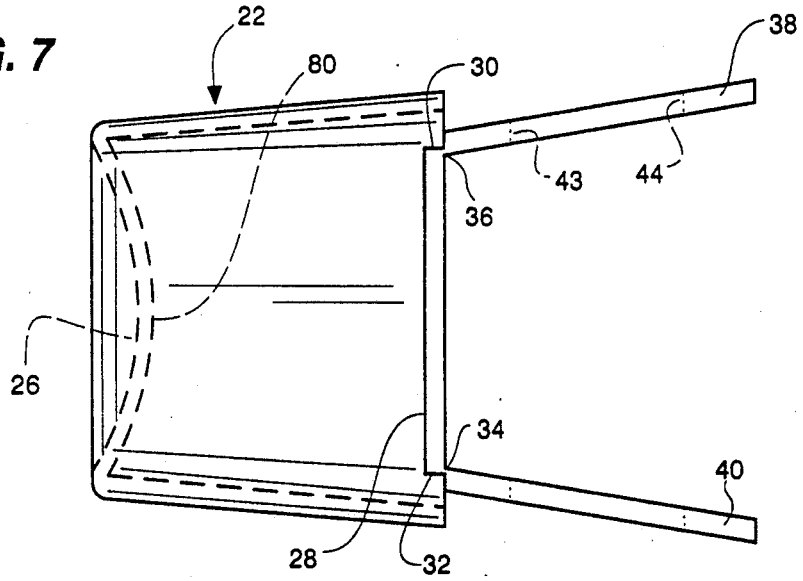
FIG. 7 is a bottom plan view of the tamper evident cover assembly.

To facilitate this attachment, the front wall 26 of the cover 22 is concave, as shown in FIG. 7, and has a bowed rear surface 80 which bears against the front end of the nozzle cap 18. The cover 22 is made of a flexible plastic material such that the front wall 26 defines a spring and is deformed when it is pulled against the front end of the nozzle cap 18 when the trigger is squeezed until the frangible connections 34 and 36 break. At this time, the front wall 26 acts as a spring causing the broken away cover 22 to pop forwardly off of the nozzle cap 18.

In view of the elongate front-to-back oval shape of the openings 42 and the detents 58 and 60, the flanges 38 and 40, after being broken away from the cover 22, are retained in a generally horizontal position between the wall portions 46 and an opposite side wall 48 or 50 of the trigger 14 and are not engaged by a user of the trigger sprayer 10.

From the foregoing description, it will be apparent that the tamper evident cover assembly 20 for use with a trigger sprayer 10 of the present invention has a number of advantages some of which have been described above and others of which are inherent in the invention. Accordingly, the scope of the invention is only to be limited as necessitated by the accompanying claims.

We claim:

1. A tamper evident cover assembly for a sprayer nozzle of a trigger sprayer of the type including a body, a trigger movably mounted to the body for operating a pumping mechanism upon actuation thereof and a sprayer nozzle at the front end of the body, said tamper evident cover assembly comprising:

a cover for the nozzle;

at least one flange extending rearwardly from said cover and having first coupling means thereon for coupling to the trigger, a frangible connection between said flange and said cover, and, second coupling means on the trigger for coupling with said first coupling means upon said flange, whereby actuation of the trigger will cause said cover to be pulled against the nozzle to cause tensioning and breaking of said frangible connection between said flange and said cover, such breaking of said frangible connection being evidence of tampering with the trigger sprayer.

2. The tamper evident cover assembly of claim 1 wherein said first coupling means comprises an opening in said flange and said second coupling means comprises a detent on a side of the trigger.

3. The tamper evident cover assembly of claim 2 wherein said opening in said flange is generally oval shaped.

4. The tamper evident cover assembly of claim 2 wherein said detent extends laterally outwardly form a side of said trigger sprayer and has a rounded back surface.

5. The tamper evident cover assembly of claim 2 wherein said detent has an inclined ramp forming front surface to allow said flange to be easily mounted over said detent by sliding said flange up said inclined ramp surface and over said detent with said detent being snap-fittingly received in said opening.

6. The tamper evident cover assembly of claim 1 wherein said frangible connection between said flange and said cover is a line of reduced thickness material between a front end of said flange and said cover.

7. The tamper evident cover assembly of claim 1 wherein said cover is cup shaped with the sides of the cup being configured to be received over and mate with the sides of the nozzle at the front end of sa trigger sprayer and said cover having a concave from wall defining the bottom of said cup, such that the inner surface of said front wall bears against the nozzle in a spring like manner whereby, when the trigger is actuated, said inside front wall of said cover is deformed as it is pressed against the front of the nozzle until said frangible connection breaks and said cover pops forwardly off the nozzle under the spring action of said front wall.

8. The tamper evident cover assembly of claim 1 wherein said cover has first and second flanges extending rearwardly therefrom, each having said first coupling means, and the trigger having said second coupling means on either side thereof for engaging and coupling with said first coupling means.

9. The tamper evident cover assembly of claim 8 further including a panel portion fixed to and depending from a rear lower edge of said cover and having opposite side edges, each of said first and second flanges being connected by said frangible connection to respective ones of said side edges of said panel portion.

10. The tamper evident cover assembly of claim 9 wherein each of said frangible connections comprises a reduced thickness of material between a front side edge of each of said flanges and one of said opposite side edges of said panel portion.

11. The tamper evident cover assembly of claim 9 wherein each of said flanges has an opening therein defining said first coupling means and the trigger has detents on opposite sides thereof defining said second coupling means.

* * * * *

UNITED STATES PATENT AND TRADEMARK OFFICE

CERTIFICATE OF CORRECTION

PATENT NO. : 5,207,359

DATED : May 4, 1993

INVENTOR(S) : Emile B. Steijns

It is certified that error appears in the above-indentified patent and that said Letters Patent is hereby corrected as shown below:

Column 4, line 37 "form" should be —from—.

Column 4, line 53 "sa" should be —a—.

Column 4, line 54 "from" should be —front—.

Signed and Sealed this

Thirty-first Day of May, 1994

Bruce Lehman

*Attest:*

BRUCE LEHMAN

*Attesting Officer*

*Commissioner of Patents and Trademarks*